United States Patent [19]

Yoneyama et al.

[11] 4,135,931

[45] Jan. 23, 1979

[54] METHOD OF IMAGE FORMATION

[75] Inventors: Masakazu Yoneyama; Yoshiharu Fuseya; Norihiko Kato; Senzo Sasaoka; Shoji Ishiguro, all of Minami-ashigara, Japan

[73] Assignee: Fuji Photo Film Co., Ltd., Minami-ashigara, Japan

[21] Appl. No.: 828,113

[22] Filed: Aug. 26, 1977

[30] Foreign Application Priority Data

Aug. 27, 1976 [JP] Japan ..... 51-102266

[51] Int. Cl.[2] ..... G03C 5/30; G03C 1/06

[52] U.S. Cl. ..... 96/66.3; 96/95

[58] Field of Search ..... 96/107, 66.3, 66.4, 96/66.5, 95

[56] References Cited

U.S. PATENT DOCUMENTS

| | | | |
|---|---|---|---|
| 2,940,851 | 6/1960 | Beavers et al. | 96/107 |
| 2,940,855 | 6/1960 | Beavers et al. | 96/107 |
| 2,944,898 | 7/1960 | Beavers et al. | 96/107 |
| 3,017,270 | 1/1962 | Tregillus et al. | 96/107 |
| 3,520,689 | 7/1970 | Nagae et al. | 96/66.3 |
| 3,671,247 | 6/1972 | Yoneyama et al. | 96/66.3 |
| 3,749,574 | 7/1973 | Pollet et al. | 96/66 R |
| 3,847,618 | 11/1974 | Hofman et al. | 96/66.3 |
| 3,880,660 | 4/1975 | Ishihara et al. | 96/66.4 |
| 3,972,719 | 8/1976 | Vanreusel et al. | 96/66.5 |
| 4,062,684 | 12/1977 | Hara et al. | 96/60 BF |

*Primary Examiner*—Mary F. Kelley

*Attorney, Agent, or Firm*—Sughrue, Rothwell, Mion, Zinn and Macpeak

[57] ABSTRACT

A method of forming an image which comprises development processing an image-wise exposed silver halide photosensitive element in the presence of at least one compound represented by the following general formula (I):

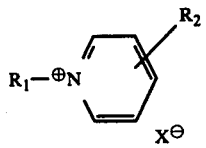

(I)

wherein $X^{\ominus}$ represents an anion; $R_1$ represents a —Y—$R_3$ group, a —Y—$COOR_3$ group, a —Y—O-$COR_3$ group, a —Y'—COO—Y—OCO—$R_3$ group, a —Y'—OCO—Y—COO—$R_3$ group or a —Y'—COO—Y—COO—$R_3$ group; Y represents an alkylene group having 1 to 18 carbon atoms, an arylene group or an aralkylene group; $R_3$ represents an alkyl group having 1 to 18 carbon atoms, an aryl group, an aralkyl group, a

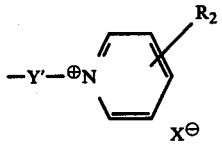

group or a

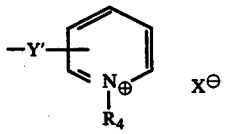

group; $R_4$ represents an alkyl group having 1 to 18 carbon atoms, an aryl group or an aralkyl group; $R_2$ represents a hydrogen atom, a halogen atom, an alkyl group having 1 to 12 carbon atoms, an aryl group having 6 to 12 carbon atoms, an aralkyl group having 7 to 12 carbon atoms, an oxycarbonyl group (—$COOR_5$ wherein $R_5$ represents an alkyl group having 1 to 18 carbon atoms or an aryl group), an acyloxy group having 1 to 18 carbon atoms, an alkoxy group having 1 to 18 carbon atoms, an amino group, a substituted amino group, an acylamino group, a sulfonamido group, a carbamoyl group, a

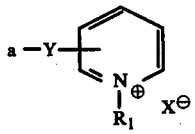

group or $R_1$; Y' is an alkylene group having 1 to 12 carbon atoms, an arylene group, an aralkylene group or a single bond; with the proviso that $R_1$ or $R_2$ contains at least one ester group.

15 Claims, No Drawings

METHOD OF IMAGE FORMATION

BACKGROUND OF THE INVENTION

1. Field of the Invention

The present invention relates to a method of image formation using silver halide photosensitive elements and particularly to an improvement in adaptability to developing agents in image formation based on graphic art lithographic type silver halide photosensitive elements (hereinafter, referred to as lith-type photosensitive elements).

A lith-type photosensitive element, comprising a support having coated thereon silver halide photographic emulsions having a very high contrast characteristic, are processed with a special type of extremely high contrast developer (hereinafter referred to as a lith-type developer) to provide a very contrasty image comprising half-tone dots and lines, and are used as photographic originals for printing plates. A lith-type developer is an alkaline solution, a so-called "infectious developer" which conventionally contains a dihydroxybenzene type principal developing agent and, in addition, for example, an aldehyde-alkali metal bisulfite as a preservative. In the course of the development, the dihydroxybenzene derivatives are infectiously activated in turn and cause a rapid development, which results in a high contrast image being obtained.

In this type development, a long time is required until the start of blackening (in other words, the initial development in this type development is slow). On the contrary, since the contrast begins to reduce without a substantial change in the photographic density in the final development, this type development has a defect that the image quality, particularly the dot quality, is deteriorated.

It has been desired to accelerate the above-described initial development as quickly as possible and, in addition, to reduce the deterioration of the image quality at the final development so that the high sensitivity and a satisfactory image quality, particularly high contrast and high photographic density, can be always obtained over a wide range of developing times, i.e., from the initial development to the final development.

In addition, the image quality obtained in the step of development using a lith-type developer tends to depend on the degree or manner or agitation of the developing solution at development.

For example, in a manual method using a tray for development processing, the contrast, photographic sensitivity and dot quality of the image obtained are strongly influenced by changes in the time and strength of agitation of the developing solution.

In addition, there is usually a considerable difference in the image quality obtained due to a difference in the agitation between a manual method and a method using an automatic processor. Furthermore, the image quality obtained often varies according to the type of automatic processor, since there is also a difference in the method and strength of the agitation between different types of the processors. Moreover, commonly a developing solution is not always agitated uniformly even in the same automatic processor and there is also a difference in agitation between positions in the processor. In consequence, where a large size film is uniformly exposed to light through a half tone screen and then is subjected to development processing, the lack of uniformity of development due to the irregularity of agitation of the developing solution tends to occur in both the width and the length direction of the film. It has been desired to develop a method of image formation which is not as adversely affected by factors such as the agitation of the developing solution.

On the other hand, a lith-type developer is usually prepared by mixing a first solution primarily containing a principal developing agent and a second solution primarily containing an alkali agent just before the use of the developer. The pH of the developer thus-prepared varies according to a change in the mixing ratio of the first solution to the second solution as described above.

The change in pH of the lith-type developer (macroscopic pH change) seriously affects the photographic properties of the image obtained on development of a lith-type photosensitive element and consequently causes a change in photographic sensitivity and the like. Moreover, the photographic properties are considerably affected by a microscopic difference in pH during development between, for example, an exposed portion and an unexposed portion in the photosensitive element.

In view of the above, it has been desired to develop a method of image formation using a lith-type photosensitive element which is not as adversely affected by such a macroscopic and microscopic change in pH.

In addition, commonly in a system of processing a large amount of photosensitive elements with the same developing solution over long periods of time, the image quality obtained by development processing with a so-called "fatigued developer" is generally inferior to that obtained with a fresh developer at the beginning of development processing after the preparation thereof. It is common for the dot quality obtained using a fatigued developer of the lith-type after a mass processing with a lapse of a long time, in particular, to be quite inferior to that obtained with a fresh developer. In consequence, it has been desired to develop a method of image formation which provides an image quality with which no or reduced deterioration occurs using a fatigued developer, when compared to using a fresh developer.

SUMMARY OF THE INVENTION

A principal object of the present invention, therefore, is to provide a method of image formation which comprises development processing a silver halide photosensitive element, a lith-type photosensitive element in particular; whereby the initial development can be accelerated while photographically adverse effects, deterioration of the dot quality, in particular, at the last part of the development can be reduced to as low as possible.

A second object of the present invention is to provide a method of image formation using a lith-type photosensitive element, which method is less influenced by changes in both the agitation and the pH of a developing solution.

A third object of the present invention is to provide a lith-type photosensitive element which exhibits a quick initial development and which does not show or shows less deterioration of the photographic properties even at the last part of the development.

A fourth object of the present invention is to provide a lith-type photosensitive element, the photographic properties of which are not as affected by changes in both agitation and pH of the lith-type developer and, in addition, by the degree of the fatigue of the developer.

The above objects of the present invention have been attained by a method of forming an image which comprises development processing an image-wise exposed silver halide photosensitive element in the presence of at least one compound represented by the following general formula (I):

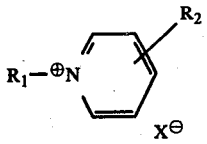

(I)

wherein $X^{\ominus}$ represents an anion (e.g., a halogen ion, toluenesulfonate ion, methylsulfate ion, perchlorate ion, etc.); $R_1$ represents a —Y—$R_3$ group, a —Y—$COOR_3$ group, a —Y—$OCOR_3$ group, a —Y'—COO—Y—O-CO—$R_3$ group, a —Y'—OCO—Y—COO—$R_3$ group or a —Y'—COO—Y—COO—$R_3$ group; Y represents an alkylene group having 1 to 18 carbon atoms (preferably having 1 to 8 carbon atoms), an arylene group (preferably having 6 to 12 carbon atoms) or an aralkylene group (preferably having 7 to 12 carbon atoms); $R_3$ represents an alkyl group having 1 to 18 carbon atoms (preferably having 1 to 8 carbon atoms), an aryl group (preferably having 6 to 12 carbon atoms), an aralkyl group (preferably having 7 to 12 carbon atoms), a

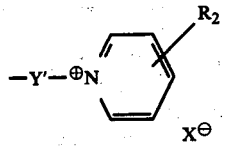

group or a

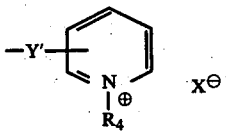

group; $R_4$ represents an alkyl group having 1 to 18 carbon atoms (preferably having 1 to 8 carbon atoms), an aryl group (preferably having 6 to 12 carbon atoms) or an aralkyl group (preferably having 7 to 12 carbon atoms); $R_2$ represents a hydrogen atom, a halogen atom (preferably a chlorine atom or a bromine atom), an alkyl group having 1 to 12 carbon atoms (preferably 1 to 6 carbon atoms), an aryl group having 6 to 12 carbon atoms (preferably 6 carbon atoms), an aralkyl group having 7 to 12 carbon atoms (preferably 8 to 10 carbon atoms), an oxycarbonyl group (i.e., —$COOR_5$ wherein $R_5$ represents an alkyl group having 1 to 18 carbon atoms (preferably having 1 to 8 carbon atoms) or an aryl group (preferably having 6 to 12 carbon atoms)), an acyloxy group having 1 to 18 carbon atoms (preferably having 1 to 8 carbon atoms), an alkoxy group having 1 to 18 carbon atoms (preferably having 1 to 8 carbon atoms), an amino group, a substituted amino group (e.g., —$NHCOR_6$, —$NHSO_2R_6$, —$NHR_6$ where $R_6$ represents an alkyl group having 1 to 6 carbon atoms), an acylamino group (preferably having 1 to 8 carbon atoms), a sulfonamido group (preferably having 1 to 6 carbon atoms), a carbamoyl group (preferably havign 1 to 6 carbon atoms), a

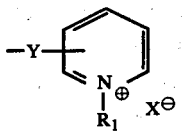

group or $R_1$; Y' represents an alkylene group having 1 to 12 carbon atoms (preferably having 1 to 8 carbon atoms), an arylene group (preferably having 6 to 12 carbon atoms), an aralkylene group (preferably having 7 to 12 carbon atoms) or a single bond; wherein $R_1$ or $R_2$ contains at least one ester group.

DETAILED DESCRIPTION OF THE INVENTION

Of these compounds which fall within the scope of the general formula (I), preferably compounds, in particular, are illustrated by the following general formula (II), (III), (IV) or (V):

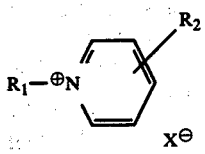

(II)

wherein $X^{\ominus}$ represents an anion (e.g., a halogen ion, etc.); $R_2$ represents a hydrogen atom, an alkyl group having 1 to 12 carbon atoms, more preferably 1 to 6 carbon atoms, an aryl group having 6 to 12 carbon atoms, more preferably 6 carbon atoms, an aralkyl group having 7 to 12 carbon atoms, more preferably 8 to 10 carbon atoms, an alkoxy group having 1 to 12 carbon atoms, an oxycarbonyl group having 1 to 12 carbon atoms, an acyloxy group having 1 to 12 carbon atoms, an amino group, an acylamino group, a sulfonamido group, a halogen atom, a carbamoyl group or a

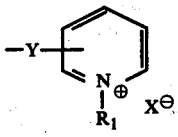

group; $R_1$ represents a —Y—$COOR_3$ group or a —Y—$OCOR_3$ group; Y represents an alkylene group having 1 to 18 carbon atoms, an arylene group or an aralkylene group; $R_3$ represents an alkyl group having 1 to 18 carbon atoms, an aryl group or an aralkyl group;

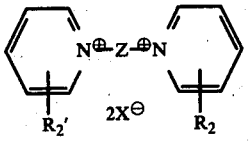

(III)

wherein $X^{\ominus}$ represents an anion (e.g., a halogen ion, etc.); Z represents a divalent organic group containing at least one ester bond with examples including a —Y—COO—Y— group, a —Y—COO—Y—O-CO—Y— group, a —Y—OCO—Y—COO—Y— group and a —Y—COO—Y—COO—Y— group; Y represents an alkylene group having 1 to 18 carbon atoms, an arylene group or an aralkylene group; $R_2$ and $R_2'$ each represents a hydrogen atom, an alkyl group having 1 to 12 carbon atoms, more preferably 1 to 6 carbon atoms, an aryl group having 6 to 12 carbon atoms, more preferably 6 carbon atoms, an aralkyl group having 7 to 12 carbon atoms, more preferably 7 to 8 carbon atoms, an alkoxy group having 1 to 18 carbon atoms, an oxycarbonyl group having 1 to 18 carbon atoms, an acyloxy group having 1 to 18 carbon atoms, an amino group, an acrylamino group, a sulfonamido group, a halogen atom or a carbamoyl group;

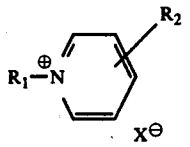

(IV)

wherein $X^{\ominus}$ represents an anion (e.g., a halogen ion, etc.); $R_2$ represents an oxycarbonyl group having 1 to 18 carbon atoms, an acyloxy group having 1 to 18 carbon atoms,

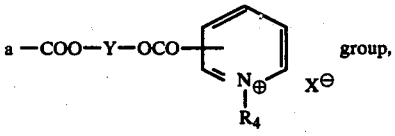

group,

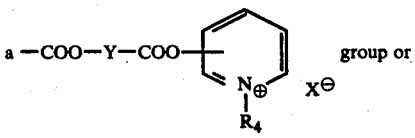

group or

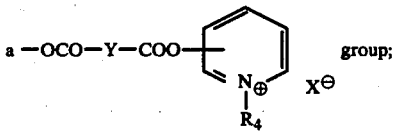

group;

Y represents an alkylene group having 1 to 18 carbon atoms, an arylene group or an aralkylene group; $R_4$ represents an alkyl group having 1 to 12 carbon atoms, more preferably 1 to 6 carbon atoms, an aryl group having 6 to 12 carbon atoms, more preferably 6 carbon atoms, or an aralkyl group having 7 to 12 carbon atoms, more preferably 7 to 8 carbon atoms; or

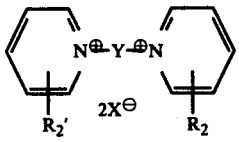

(V)

wherein $X^{\ominus}$ represents an anion (e.g., a halogen ion, etc.); Y represents a divalent organic group with examples including an alkylene group having 1 to 18 carbon atoms, an arylene group and an aralkylene group; $R_2$ and $R_2'$ each represents an oxycarbonyl group having 1 to 18 carbon atoms or an acyloxy group having 1 to 18 carbon atoms.

Specific examples of compounds which fall within the scope of the general formula (II) are illustrated below.

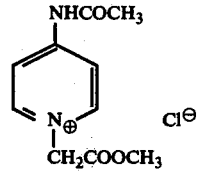

(1)

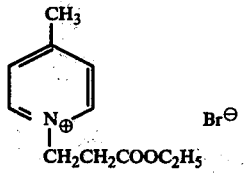

(2)

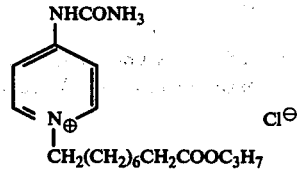

(3)

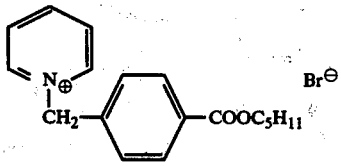

(4)

Specific examples of compounds which fall within the scope of the general formula (III) are illustrated below.

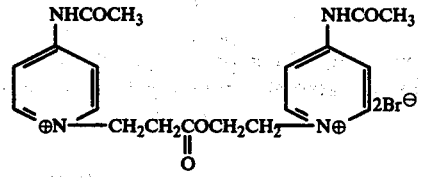

(5)

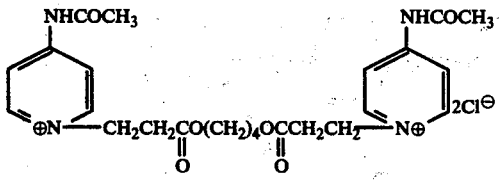

(6)

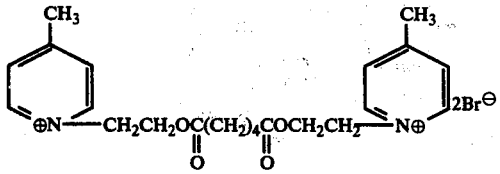

(7)

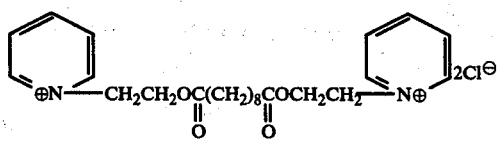

(8)

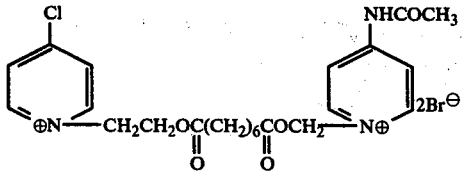

(9)

-continued

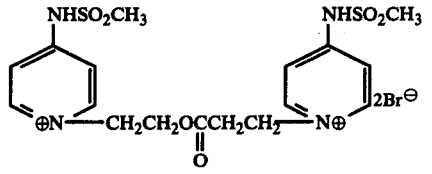

(10)

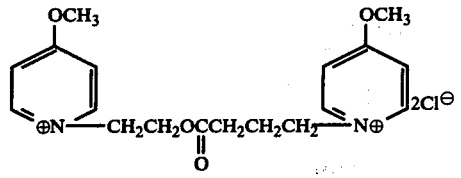

(11)

Specific examples of compounds which fall within the scope of the general formula (IV) are illustrated below.

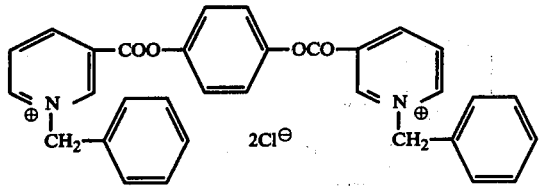

(12)

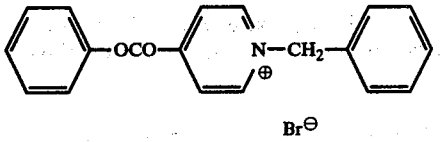

(13)

Specific examples of compounds which fall within the scope of the general formula (V) are illustrated below.

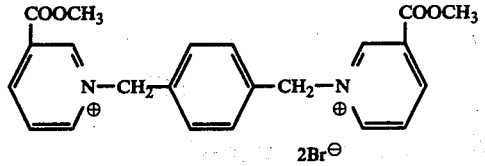

(14)

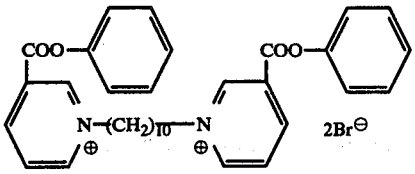

(15)

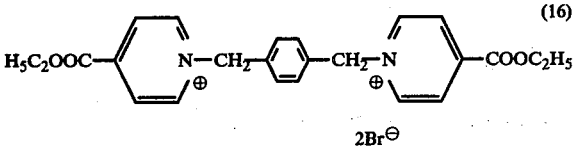

(16)

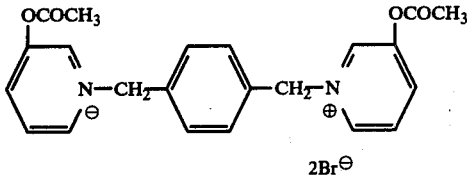

(17)

All of the compounds which are used in the present invention can be synthesized in accordance with the following synthesis examples.

SYNTHESIS EXAMPLE 1

Synthesis of Compound (5)

(1) Synthesis of 4-Acetylaminopyridine

Into 1,500 ml of acetone were dissolved 94 g (1 mol) of 4-aminopyridine and 101 g (1 mol) of triethylamine. To the resultant solution was added dropwise 78.5 g (1 mol) of acetyl chloride at room temperature (about 20°-30° C.) over a 1 hour period with stirring. After that, the mixture was additionally agitated at the same temperature for 4 hours. After the triethylamine-hydrochloric acid salt had been removed by filtration, the filtrate was distilled off and then the residue was recrystallized from water. Yield: 84.6 g (54.9%).

The product was a monohydrate.

| Elemental Analysis | C | H | N |
|---|---|---|---|
| Calc'd for $C_7H_8N_2O$ (%): | 54.55 | 6.49 | 18.18 |
| Found (%): | 54.26 | 6.59 | 18.20 |

(2) Synthesis of 3-Bromopropanoyloxy-2-bromoethane

Into 250 ml of toluene were dissolved 76.5 g (0.5 mol) of 2-bromopropionic acid and 125 g (1.0 mol) of bromoethylenehydrin. Three or four drops of sulfuric acid (98 wt% aq. soln.) was added to the resultant solution and then an approximately stoichiometric amount of water which was produced as a by-product was removed from the reaction system, while refluxing by heating for about 2 hours. After chilling the reaction solution to 20-30° C., about 1 ml of benzene was added thereto and then the solution was washed with water (about 1,000 ml) two or three times. An organic solution layer was separated by fractionation and then dried over anhydrous sodium sulfate. After distilling off the benzene from the organic solution, the residue was distilled to provide the product as a fraction having a boiling point of 100° C./2.8 mmHg. Yield: 82 g (63%).

| Elemental Analysis | C | H |
|---|---|---|
| Calc'd for $C_5H_8O_2Br_2$ (%): | 23.10 | 3.10 |
| Found (%): | 23.39 | 3.12 |

(3) Synthesis of 1,7-bis(4-Acetylaminopyridinio)-3-oxa-4-hexanone Dibromide

Into 100 ml of ethanol were dissolved 92.4 g (0.6 mol) of 4-acetylaminopyridine monohydrate and 78 g (0.3 mol) of 3-bromopropanoyloxy-2-bromethane, each prepared as described above, and the solution was agitated at 80° C. for 1 hour. The resultant reaction mixture began to solidify, as the reaction advanced. Crystals were separated by filtration of the reaction mixture and then were dissolved in a small amount of water (about 150 ml) for recrystallization with acetone (this procedure was repeated twice). Yield: 112 g (70%). M.P.: 246-247° C.

| Elemental Analysis | C | H | N |
|---|---|---|---|
| Calc'd for $C_{19}H_{24}N_4O_4Br_2$ (%): | 42.87 | 4.51 | 10.53 |
| Found (%): | 42.82 | 4.53 | 10.54 |

SYNTHESIS EXAMPLE 2

Synthesis of Compound (14)

50 ml of toluene was added to a mixture of 11.5 g of methyl nicotinate and 11 g of α, α'-dibromo-p-xylene and then the mixture was refluxed by heating. After 3 hours, crystals which were deposited on cooling were separated by filtration and recrystallized with n-butanol to obtain the desired product having a melting point of 175–179° C.

| Elemental Analysis | C | H | N |
|---|---|---|---|
| Calc'd for $C_{22}H_{22}N_2O_4Br_2$ (%): | 49.07 | 4.12 | 5.20 |
| Found (%) : | 48.76 | 4.20 | 4.96 |

SYNTHESIS EXAMPLE 3

Synthesis of Compound (15)

To a mixture of 32.5 g of phenyl nicotinate and 24.5 g of 1,10-dibromodecane was added 200 ml of methyl ethyl ketone and the mixture was refluxed by heating for 50 hours. Crystals which were deposited were separated by filtration and then recrystallized from n-butanol to obtain the desired product having a melting point of 165–166° C.

| Elemental Analysis | C | H | N |
|---|---|---|---|
| Calc'd for $C_{34}H_{38}N_2O_4Br_2$ (%): | 58.45 | 5.44 | 4.01 |
| Found (%): | 58.23 | 5.55 | 3.92 |

The compounds of the general formula (I) which are used in the present invention can be incorporated into a photosensitive element and/or a developing solution, preferably in a photosensitive element, in particular.

Of the photosensitive element, the compound of the general formula (I) is preferably incorporated in a silver halide photographic emulsion layer and/or a layer adjacent thereto.

The amount of the compound of the general formula (I) used is in the range of about 0.0005 g to about 10 g, preferably 0.001 g to 1 g, in particular, per mol of silver halide.

Although the present invention does not have any particular limitation on the time at which the compound of the general formula (I) is added, it is preferred for the compound of the general formula (I) to be added to a photographic layer after chemical ripening but prior to coating of the photographic layer.

The objects of the present invention have been attained for the first time by using a compound which is represented by the general formula (I). On the other hand, these objects cannot be attained even by using a quaternary pyridinium compound known in the prior art, with examples of such being the following compounds:

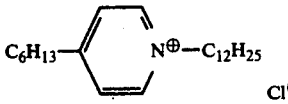

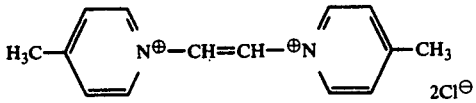

-continued

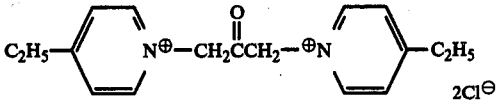

as disclosed in British Pat. No. 1,098,748.

The quaternary pyridinium compound which is used in the present invention is characterized by the presence of at least one ester bond in the chemical structure thereof. It is believed that the superior effect which is not attained with the quaternary pyridinium compounds of the prior art has been attained by the presence of at least one ester bond.

Silver halide emulsions which can be used in the present invention can be prepared using any of the methods described in, for example, C. E. K. Mees & T. H. James, *The Theory of the Photographic Process*, 3rd Edition, pp. 31 to 43, Macmillan Co., New York (1967), P. Grafkides, *Chimie Photographique*, 2nd Edition, pp. 251 to 308, Paul Montel Co., Paris (1957), etc., including the neutral, acidic, single jet, double jet and controlled double jet methods, etc.

Preferred silver halides are silver bromochloride or silver iodobromochloride which contain at least about 60 mol% silver chloride (more preferably not less than 75 mol%), and from 0 to about 5 mol% silver iodide, the remainder being silver bromide. Although the present invention does not have any particular limitation on the crystal shape, the crystal habit and the grain size distribution of the silver halide grains, grains not larger than about 0.7 μ in diameter are preferred.

The sensitivity of the silver halide emulsion can be increased, without any growth of the silver halide grains, by the use of certain gold compounds, such as chloroaurate salts, gold trichloride, etc., salts of noble metals, such as rhodium, iridium, etc., sulfur compounds capable of reacting with the silver halide to form silver sulfide, and certain reducing compounds including stannous salts, amines, etc.

Suitable binders for dispersing the silver halide include gelatin, modified gelatin, gelatin derivatives and synthetic hydrophilic polymers.

The silver halide emulsion layer or other hydrophilic colloid layers can also contain, in the form of a latex thereof, homo- or copolymers, e.g., alkyl acrylates, alkyl methacrylates, acrylic acid, glycidyl acrylates, etc. for the purpose of improving the dimensional stability of the resulting photosensitive element, or improving the physical properties of the coated film. Such techniques are disclosed in U.S. Pat. Nos. 3,411,911, 3,411,912, 3,142,568, 3,325,286, 3,547,650, Japanese Pat. Publication No. 5331/1970, etc.

Photographic emulsions used for the present invention can also contain any anti-fogging agents well known in the art and described in Japanese Pat. applications (OPI) 81024/1974, 6306/1975 and 19429/1975, and U.S. Pat. No. 3,850,639, including various heterocyclic compounds, mercury-containing compounds and mercapto compounds, such as 4-hydroxy-6-methyl-1,3,3*a*,7-tetrazaindene, 3-methylbenzothiazole, 1-phenyl-5-mercaptotetrazole, etc.

The silver halide lith-type emulsions for use in the present invention can be ortho- or panchromatically spectrally sensitized or supersensitized with one or more cyanine dyes including a cyanine dye, a merocyanine dye, a carbocyanine dye, etc., or in combination with a styryl dye or other suitable dyes. Of the various sensitizing dyes, those described in Japanese Pat. applications Nos. 20623/1975 and 93833/1975, and in U.S. Pat. No. 3,567,458 are particularly suitable.

Hardeners which can be used and on which also no particular limitation is imposed by the present invention include aldehyde or ketone compounds, compounds containing reactive halogen atoms such as 2-hydroxy-4,6-dichloro-1,3,5-triazine, reactive olefinic compounds such as the compounds as disclosed in Japanese Pat. applications (OPI) 74832/1973 and 13563/1974 and Japanese Patent Applications 115611/1976 and 132929/1976, N-methylol compounds, aziridine compounds, carbodiimide compounds, etc.

Further, the photographic emulsions for use in the present invention can contain surface active agents as coating aids or in order to improve the photographic properties.

Suitable surface active agents include natural surfactants such as saponin; nonionic surfactants such as alkylene oxides (e.g., those described in Japanese Patent applications (OPI) Nos. 156423/1975 and 69124/1974), glycidols, etc.; anionic surfactants containing acidic groups such as carboxylic, sulfonic (those disclosed in, e.g., U.S. Pat. No. 3,415,649), phosphoric, sulfuric acid ester, phosphoric ester, etc., groups; and amphoteric surfactants such as amino acids, aminosulfonic acids, sulfuric or phosphoric acid esters of amino alcohols, etc.

It is known that a lith-type photosensitive element is usually developed with a developing solution containing a small amount of sulfite ion so as to improve the dot quality and if a polyethylene oxide type compound is present in a light-sensitive layer thereof during development, the dot quality is further improved.

These compounds which have heretofore been known include polyalkylene oxides and condensation products of polyethylene oxides and aliphatic alcohols, glycols, aliphatic acids, aliphatic amines, phenols, dehydrated cyclic compounds of hexitol derivatives (such as sorbitan) or the like. These compounds are disclosed in, for example, U.S. Pat. Nos. 3,288,612, 3,345,175, 3,294,540 and 3,516,830. Specific examples of these compounds are illustrated below.

$HOCH_2CH_2O-(CH_2CH_2O)_{50}-CH_2CH_2OH$ $HOCH_2CH_2O-(CH_2CH_2O)_{100}-CH_2CH_2OH$ $(CH_2)_{10}$ < $O-(CH_2CH_2O)_{10}-CH_2CH_2OH$ / $O-(CH_2CH_2O)_{10}-CH_2CH_2OH$ $HOCH_2CH_2O-(CH_2CH_2O)_{25}-C_{17}H_{25}$ $H-(OCH_2CH_2)_a-(OCH_2\underset{\underset{CH_3}{|}}{CH})_b-(OCH_2CH_2)_c-OH$

[a + c = 18, b = 22]

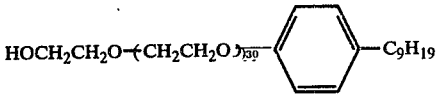

$H-(OCH_2CH_2)_a-(OCH_2CH_2CH_2CH_2)_b-(OCH_2CH_2)_c-OH$

[a + c = 30, b = 15]

-continued

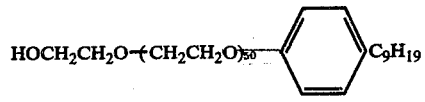

$HOCH_2CH_2-(OCH_2CH_2)_{50}-NHC_{12}H_{25}$ $HOCH_2CH_2O-(CH_2CH_2O)_{40}CO-(CH_2)_7CH=CHC_8H_{17}$ $HO-(CH_2CH_2O)_a-(CH_2CH_2CH_2CH_2O)_{14}-(CH_2CH_2O)_c-H$

[a + c = 35]

In addition, the compound represented by the general formula (I) which is used in the present invention can be employed in combination with a development-accelerating agent well known to those skilled in the art. These known development-accelerating agents which can be used include those disclosed in, for example, U.S. Pat. Nos. 3,288,612, 3,333,959, 3,345,175 and 3,708,303, British Pat. No. 1,098,748, West German Pat. Nos. 1,141,531 and 1,183,784.

As to other additives for the emulsion and the manufacturing processes for the photographic material, reference can be made to *Product Licensing Index*, Vol. 92, pp. 107 to 110 (1971).

A photographic emulsion which can be used in the present invention can be coated onto a flexible support which does not undergo a marked dimensional change, with examples including a cellulose acetate film, a polyethylene terephthalate film, a polycarbonate film, a polystyrene film or the like.

In order to obtain a photographic image in accordance with the present invention, the photosensitive element is image-wise exposed in a conventional manner used in the photographic art. Various light sources can be used for exposure, including a tungsten lamp, a carbon arc lamp, a fluorescent lamp, a xenon arc lamp, a xenon flash lamp, a cathode ray tube flying spot scanner, a glow tube lamp, a laser beam (e.g., an argon laser), and a luminous diode.

Exposure times which can be used range from about 10 to about 1/1,000 second, or shorter than about 1/1,000 second, e.g., from $10^{-4}$ to $10^{-6}$ second. Depending on the practical requirements, the spectral range of light employed for exposure can be controlled using a color filter.

A lith-type developer suitable for practicing the present invention basically comprises an o- or p-dihydroxybenzene, an alkali agent, a small amount of a sulfite salt, a sulfite ion buffer and the like. The o- or p-dihydroxybenzene as a principal developing agent can be optionally selected from those well known in the photographic art. Specific examples of these compounds include hydroquinone, chlorohydroquinone, bromohydroquinone, isopropylhydroquinone, toluhydroquinone, methylhydroquinone, 2,3-dichlorohydroquinone, 2,5-dimethylhydroquinone, etc., of which hydroquinone is most preferred in practice. These principal developing agents can be used individually or in combination. The amount of the principal developing agent which can be employed ranges from about 1 to about 100 g per liter of developer, preferably from 5 to 80 g per liter of developer.

The sulfite ion buffer is used in an amount which effectively maintains the sulfite salt concentration substantially constant in the developer, with suitable compounds being aldehyde-alkali metal bisulfite adducts, such as formaldehyde-$NaHSO_3$ adduct, ketone-alkali metal bisulfite adducts such as acetone-$NaHSO_3$ adduct or carbonyl bisulfiteamine condensates, such as Na-bis(2-hydroxyethyl)aminomethane sulfonate, etc. The amount of the sulfite ion buffer which can be used ranges from about 13 to about 130 g per liter of developer.

In order to provide the developer with a pH of at least about 9 (particularly between 9.7 and 11.5), an alkaline agent is added to the developer. Sodium carbonate, potassium carbonate and the like are generally used as alkaline agents.

The concentration of free sulfite ion in the developer used for the present invention can be controlled by adding an alkali metal sulfite such as sodium sulfite. In general, the sulfite salt is employed in an amount not higher than about 5 g and more preferably not more than 3 g, per liter, although, of course, more than about 5 g per liter can be used, if desired.

In many cases, developers should preferably contain development regulating agents, such as alkali metal halides (particularly, bromide salts, such as sodium bromide and potassium bromide) in an amount of from about 0.01 to about 10 g, more preferably from 0.1 to 5 g, per liter of developer.

Further, developers for use in the present invention can optionally contain, in addition to the above-described components, a pH buffer such as a water-soluble acid (e.g., acetic acid or boric acid), an alkali (e.g., sodium hydroxide) or salt (e.g., sodium carbonate). Certain alkaline compounds not only render the developer alkaline, but also act as a pH buffer and a development controlling agent. Other components which can be added to the developer include a preservative, such as ascorbic acid, diethanolamine, and kojic acid, an anti-fogging agent such as benzotriazole, 1-phenyl-5-mercaptotetrazole, etc., and an organic solvent such as triethylene glycol, dimethylformamide, and methanol.

Since these components need only be present in the above-described developing solution at the moment of processing, the development compositions may comprise two or more separate parts prior to use. For example, a first part containing the principal developing agent in the form of a solution and a second part containing the alkaline agent may be appropriately diluted immediately prior to use.

Development of a silver halide lith-type photosensitive element can be preferably performed using a transport type automatic processor, and any film transport methods can be employed including roller and belt conveyors, thus allowing the use of any types of automatic processing machines well known in the art, such as automatic processing machines as disclosed in U.S. Pat. No. 3,705,598. As for the development methods, reference can be made to the disclosures as set forth in, for example, U.S. Pat. Nos. 3,025,779, 3,078,024, 3,122,086, 3,149,551, 3,156,173, 3,224,356, 3,573,914, etc.

Where the lith-type photosensitive element of the present invention is processed with a transport type automatic processor using a lith-type developer, the developing temperature ranges from about 20°to about 50° C., more preferably 25°to 40° C. and the developing period ranges from about 10 to about 250 seconds, more preferably from 10 to 150 seconds. The fixing, the washing and the drying are each performed without any particular limitation, using conventional techniques generally used in the photographic art.

The following examples are given to illustrate the present invention in greater detail. Unless otherwise indicated, all parts, percents, ratios and the like are by weight.

EXAMPLE 1

A gelatin silver iodobromochloride photographic emulsion was prepared by chemical ripening of a silver halide composition comprising 80 mol% of silver chloride, 19.5 mol% of silver bromide and 0.5 mol% of silver iodide. The average grain diameter of the silver halide was 0.35$\mu$.

In addition, the silver amount was about 1.6 mol per kg of the emulsion.

100 g of the emulsion was weighed into each of 11 pots. To each of the pots were added 3-carboxymethyl-5-[2-(3-ethylthiazolinylidene)ethylidene]rhodanine, 4-hydroxy-6-methyl-1,3,3a,7-tetrazaindene, mucochloric acid and polyoxyethylenenonylphenylether containing 50 ethylene oxide groups, and then each of the compounds of the present invention as shown in Table 1 below or compounds A or B for comparison, respectively, were added. The resulting mixture was each coated on a polyethylene terephthalate support such that the coating layer contained 6.0 g of silver per $m^2$. Samples 1 to 11 were thus obtained.

One half of the area of the sample thus-prepared was contact-exposed through a magenta contact screen having 150 lines per inch and the remaining half of the area of the same sample was wedge-exposed without a screen to light from a tungsten lamp, and then each sample was developed with the developer shown in Table 2 according to the development processings below. These procedures were each repeated for the 11 different samples.

Development Processing (I): tray development processing which comprised developing a photosensitive element using a tray containing 4 liters of developing solution at a developing temperature of 27° C. for a developing period of 1 minute and 10 seconds, 1 minute and 40 seconds or 2 minutes and 10 seconds, without stirring.

Development Processing (II): automatic processing which comprised developing a photosensitive element using an automatic processor Log Eflo LD-24 (manufactured by Log Electronics Co., Ltd. in the U.S.A.) at the same developing temperature and for the same developing period as in Development Processing (I).

Table 2

| Developer Solution | |
|---|---|
| Hydroquinone | 15 g |
| Formaldehyde-Sodium Bisulfite Adduct | 50 g |
| Potassium Carbonate | 30 g |
| Sodium Sulfite | 2.5 g |
| Potassium Bromide | 2.0 g |
| Boric Acid | 5.0 g |
| Sodium Hydroxide | 3.0 g |
| Triethylene Glycol | 40 g |
| Ethylenediaminetetraacetic Acid (disodium salt) | 1.0 g |
| Water to make | 1,000 cc |

After processing, the photographic sensitivity was determined and, in addition, the dot quality was evaluated using a microscope with a degree of magnification of 100. The results which were obtained are shown in Table 1 below.

In Table 1, the sensitivity of the other samples was each relatively expressed for convenience, assuming that the sensitivity of Sample 3, when developed by automatic processing at 27° C. for 1 minute and 40 seconds, was 100, although the same can be defined by the logarithm of the reciprocal of the exposure amount required to obtain a photographic density of 1.5.

The dot quality was evaluated by observing the half-tone dots (dot area 50%) of the above-described samples and was rated visually in accordance with the following grades of from A to D.

A: Excellent
B: Acceptable practically
C: Inferior
D: Very poor

TABLE 1

| Sample No. | Compound of the General Formula (I) or Comparison Compound: Compound No. | Amount Added (g/mol AgX) | Sensitivity: Automatic Development Processing 1'10" | 1'40" | 2'10" | Tray Development Processing 1'10" | 1'40" | 2'10" | Dot Quality: Automatic Development Processing 1'10" | 1'40" | 2'10" | Tray Development Processing 1'10" | 1'40" | 2'10" |
|---|---|---|---|---|---|---|---|---|---|---|---|---|---|---|
| Control 1 | — | — | 20 | 65 | 95 | 15 | 70 | 90 | D | B | A | D | B | A |
| Invention 2 | (5) | 0.130 | 70 | 95 | 115 | 85 | 100 | 120 | B | A | A | A | A | A |
| 3 | " | 0.180 | 75 | 100 (standard) | 120 | 90 | 105 | 125 | A | A | A | A | A | A |
| 4 | " | 0.220 | 90 | 110 | 125 | 95 | 115 | 130 | A | A | A | A | A | B |
| 5 | (15) | 0.045 | 70 | 90 | 105 | 90 | 105 | 120 | B | A | A | A | A | A |
| 6 | " | 0.060 | 75 | 100 | 115 | 95 | 110 | 125 | A | A | A | A | A | A |
| 7 | " | 0.070 | 85 | 105 | 120 | 100 | 115 | 130 | A | A | A | A | A | B |
| Comparison 8 | Compound A | 0.065 | 55 | 85 | 110 | 85 | 125 | 150 | C | A | A | A | B | D |
| 9 | " | 0.090 | 60 | 100 | 125 | 95 | 145 | 150 | B | A | A | A | C | D |
| 10 | Compound B | 0.030 | 35 | 70 | 105 | 80 | 115 | 150 | D | B | A | B | B | D |
| 11 | " | 0.050 | 65 | 100 | 130 | 100 | 140 | 150 | B | A | B | A | C | D |

*Development time at 27° C

Comparison Compounds A and B shown in Table 1 are quaternary pyridinium compounds represented by the structures:

Compound A

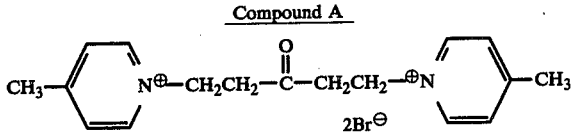

Compound B

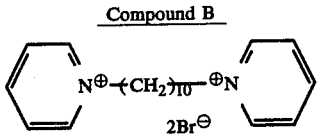

which do not fall within the compounds of the present invention.

As is apparent from the results in Table 1, the sensitivity and rate of development of the photosensitive elements containing development accelerators which are used in the present invention (i.e., Samples 2 to 7) each shows almost the same value in both automatic processing and the tray development processing. Further, the dot quality is excellent in these processings over a wide range of developing periods of time.

On the other hand, photosensitive elements containing Compound A or Compound B for comparison which compounds are similar to but outside the scope of the compounds of the present invention are each strongly affected by the degree of stirring of the developing solution, and a difference in sensitivity and rate of development occurs between these photosensitive elements developed by tray development processing without stirring and those developed by automatic processing using the Automatic Processor Log Eflo LD-24 with strong stirring. In addition, the dot quality is quite poor. In particular, the range of developing period in which an excellent dot quality can be obtained is remarkably narrow.

EXAMPLE 2

Samples 21 to 34 as shown in Table 3 below were prepared in the same manner as described in Example 1.

These samples were wedge-exposed to light and then developed with three kinds of developers having the same developer composition as shown in Table 2, except that the pH was adjusted to 10.20, 10.30 and 10.40, respectively, by changing the amount of sodium hydroxide used, employing an Automatic Processor FG-24 manufactured by Fuji Photo Film Co., Ltd. at 27° C. for 1 minute and 40 seconds. The photographic sensitivity was determined following the above-described development processing. The results as shown in Table 3 were obtained.

In Table 3, the sensitivity of the other samples was each relatively expressed, assuming that the sensitivity of Sample 23, when developed with the developer having a pH of 10.30, was 100.

Compound C for comparison in Table 3 has the following chemical formula:

Compound C

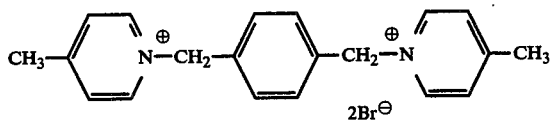

Table 3

| Sample No. | Compound of the General Formula (I) or Comparison Compound: Compound | Amount Added (g/mol of AgX) | Sensitivity: pH of Developer 10.20 | 10.30 | 10.40 |
|---|---|---|---|---|---|
| Control 21 | — | — | 10 | 55 | 120 |
| Invention 22 | (14) | 0.040 | 35 | 85 | 135 |
| 23 | " | 0.055 | 40 | 100 | 155 |

Table 3-continued

| Sample No. | Compound of the General Formula (I) or Comparison Compound: Compound | Amount Added (g/mol of AgX) | Sensitivity, pH of Developer: 10.20 | 10.30 | 10.40 |
|---|---|---|---|---|---|
| | | | | (standard) | |
| 24 | " | 0.070 | 48 | 120 | 180 |
| 25 | (6) | 0.035 | 30 | 80 | 132 |
| 26 | " | 0.060 | 38 | 105 | 175 |
| 27 | " | 0.070 | 40 | 110 | 180 |
| 28 | (3) | 0.130 | 23 | 75 | 130 |
| 29 | " | 0.170 | 28 | 95 | 162 |
| 30 | " | 0.200 | 36 | 120 | 204 |
| Comparison 31 | Compound A | 0.065 | 15 | 75 | 150 |
| 32 | " | 0.090 | 20 | 100 | 205 |
| 33 | Compound | 0.045 | 14 | 80 | 170 |
| 34 | " | 0.070 | 19 | 105 | 220 |

As is evident from the results in Table 3, the photosensitive elements containing the development accelerators which are used in the present invention (i.e., Samples 23 to 30) are relatively weakly affected by changes in the pH of the developing solution, while the photosensitive elements containing Compound A or C for comparison, which compounds are similar to but outside the scope of the compounds of the present invention, (i.e., Samples 31 to 34) are strongly influenced thereby.

EXAMPLE 3

A running test was conducted using the same films as Sample Film Nos. 23, 26, 32 and 34 as described in Example 2 and employing the same developing solution and automatic processor as those described in Example 1.

The running test was carried out by continuing the automatic processing of the sample film wherein half of the area of 50.8 cm multipled by 61.0 cm had been exposed to white light at the rate of one hundred sheets per day under the developing conditions of 27° C. and 1 minute and 40 seconds. Whenever one sheet of the sample film was developed, a supplemental solution was added to the developing solution.

After adjusting the sensitivity obtained by the developing solution after having processed 0, 200, 400 and 600, respectively, number of sheets using a commercially available control strip, the sample film having been half tone exposed to light was development processed in the same manner as in Example 1 at 27° C. for 1 minute and 40 seconds and then the dot quality of the sample was evaluated.

The above-described running test was conducted for each sample film. The results which were obtained are shown in Table 4 below.

Table 4

| Sample No. | Compound of the General Formula (I) or Comparison Compoud: Compound | Amount Added (g/mol of AgX) | Dot Quality, Number of Sheets Processed: 0 | 200 | 400 | 600 |
|---|---|---|---|---|---|---|
| 23* | (14) | 0.055 | A | A | A | A |
| 26* | (6) | 0.060 | A | A | A | A |
| 29* | (3) | 0.170 | A | A | A | B |
| 32** | Compound A | 0.090 | A | A | B | C |
| 34** | Compound C | 0.070 | A | B | B | C |

*Invention
**For Comparison

As is evident from the results in Table 4, it is understood that photosensitive elements containing a development accelerator which is used in the present invention (i.e., Samples 23, 26 and 29) each provides an excellent dot quality when a fatigued developer is used after processing of 200 to 600 sheets as well when a fresh developer (i.e., a developer not yet having been employed), and are not affected by the degree of fatigue of the developer and by deposition from the photosensitive element.

On the other hand, the photosensitive element containing Compound A or C for comparison (i.e., Samples 32 and 34) each exhibited a poor dot quality as the amount of processing solution increases (in other words, as the degree of fatigue of the developer increases and the deposition from the photosensitive element increases), which results in disadvantages in practical use.

While the invention has been described in detail and with reference to specific embodiments thereof, it will be apparent to one skilled in the art that various changes and modifications can be made therein without departing from the spirit and scope thereof.

What is claimed is:

1. A method of forming an image which comprises development processing with a lith developer an image-wise exposed silver halide photosensitive element comprising
   (i) a silver halide photographic emulsion layer; and
   (ii) a layer adjacent said silver halide photographic emulsion layer, at least one compound represented by the following general formula (I) being present in said layer i) and/or said layer ii):

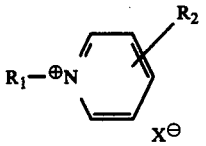

(I)

wherein $X^{\ominus}$ represents an anion; $R_1$ represents a —Y—$R_3$ group, a —Y—COO$R_3$ group, a —Y—OCO$R_3$ group, a —Y'—COO—Y—OCO—$R_3$ group, a —Y'—OCO—Y—COO$R_3$ group or a —Y'—COO—Y—COO—$R_3$ group; Y represents an alkylene group having 1 to 18 carbon atoms, an arylene group or an aralkylene group; $R_3$ represents an alkyl group having 1 to 18 carbon atoms, an aryl group, an aralkyl group,

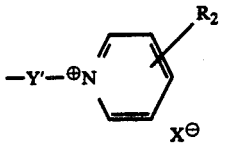

sents an alkyl group having 1 to 18 carbon atoms, an aryl group or an aralkyl group; $R_2$ represents a hydrogen atom, a halogen atom, an alkyl group having 1 to 12 carbon atoms, an aryl group having 6 to 12 carbon atoms, an aralkyl group having 7 to 12 carbon atoms, an oxycarbonyl group of the formula $—COOR_5$ wherein $R_5$ represents an alkyl group having 1 to 18 carbon atoms or an aryl group, an acyloxy group having 1 to 18 carbon atoms, an alkoxy group having 1 to 18 carbon atoms, an amino group, a substituted amino group, an acylamino group, a sulfonamido group, a carbamoyl group, a

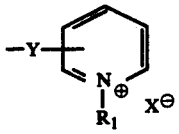

group or $R_1$; Y' is an alkylene group having 1 to 12 carbon atoms, an arylene group, an aralkylene group or a single bond; with the proviso that $R_1$ or $R_2$ contains at least one ester group.

2. The method of claim 1, wherein said compound having the general formula (I) has the general formulae (II), (III), (IV) or (V):

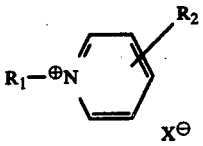

(II)

wherein $X^{\ominus}$ represents an anion; $R_2$ represents a hydrogen atom, an alkyl group having 1 to 12 carbon atoms, an aryl group having 6 to 12 carbon atoms, an aralkyl group having 7 to 12 carbon atoms, an alkoxy group having 1 to 12 carbon atoms, an oxycarbonyl group having 1 to 12 carbon atoms, an acyloxy group having 1 to 12 carbon atoms, an amino group, an acylamino group, a sulfonamido group, a halogen atom, a carbamoyl group or a

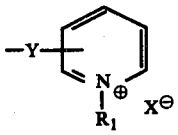

group; $R_1$ represents a $—Y—COOR_3$ group or a $—Y—OCOR_3$ group, Y represents an alkylene group having 1 to 18 carbon atoms, an arylene group or an aralkylene group; $R_3$ represents an alkyl group having 1 to 18 carbon atoms, an aryl group or an aralkyl group;

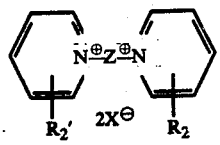

(III)

wherein $X^{\ominus}$ represents an anion; Z represents a —Y—COO—Y— group, a —Y—COO—Y—OCO—Y— group, a —Y—OCO—Y—COO—Y— group and a —Y—COO—Y—COO—Y— group; Y represents an alkylene group having 1 to 18 carbon atoms, an arylene group or an aralkylene group; $R_2$ and $R_2'$ each represents a hydrogen atom, an alkyl group having 1 to 12 carbon atoms, an aryl group having 6 to 12 carbon atoms, an aralkyl group having 7 to 12 carbon atoms, an alkoxy group having 1 to 18 carbon atoms, an oxycarbonyl group having 1 to 18 carbon atoms, an acyloxy group having 1 to 18 carbon atoms, an amino group, an acylamino group, a sulfonamido group, a halogen atom or a carbamoyl group;

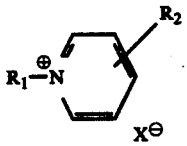

(IV)

wherein $X^{\ominus}$ represents an anion; $R_2$ represents an oxycarbonyl group having 1 to 18 carbon atoms, an acyloxy group having 1 to 18 carbon atoms, a

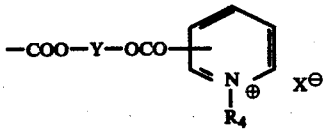

group,

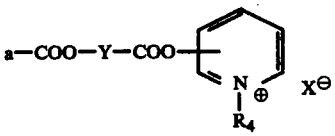

group or

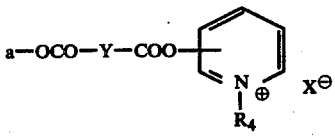

group; Y represents an alkylene group having 1 to 18 carbon atoms, an arylene group or an aralkylene group; $R_4$ represents an alkyl group having 1 to 12 carbon atoms, an aryl group having 6 to 12 carbon atoms or an aralkyl group having 7 to 12 carbon atoms; or

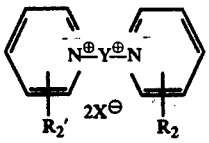

wherein $X^{\ominus}$ represents an anion; Y represents a divalent organic group; $R_2$ and $R_2'$ each represents an oxycarbonyl group having 1 to 18 carbon atoms or an acyloxy group having 1 to 18 carbon atoms.

3. The method of claim 1, wherein the amount of said compound represented by the general formula (I) is about 0.0005 g to about 10 g per mol of silver halide.

4. The method of claim 1, wherein said silver halide is silver bromochloride or silver iodobromochloride containing at least about 60 mol% silver chloride, up to about 5 mol% silver iodide and the remainder silver bromide.

5. The method of claim 1, wherein said lith developer comprises the components (a) an o- or p-dihydroxybenzene developing agent;
(b) a sulfite ion buffer;
(c) a sulfite salt; and
(d) an alkaline agent.

6. The method of claim 5, wherein the amounts of said component (a), (b) and (c) per liter of said lith developer are about 1 to about 100 grams of component (a), about 13 to about 130 grams of component (b) and not more than about 5 grams of component (c) and said component (d) is present in an amount sufficient to result in the lith developer being at a pH of at least about 9.

7. The method of claim 5, wherein said developing agent (a) is selected from the group consisting of o-dihydroxybenzene, hydroquinone, chlorohydroquinone, bromohydroquinone, isopropylhydroquinone, toluhydroquinone, methylhydroquinone, 2,3-dichlorohydroquinone or 2,5-dimethylhydroquinone.

8. The method of claim 5, wherein said sulfite ion buffer (b) is an aldehyde-alkali metal bisulfite adduct selected from the group consisting of a formaldehyde-$NaHSO_3$ adduct, a ketone-alkali metal bisulfite adduct or a carbonyl-bisulfiteamine condensate.

9. The method of claim 5, wherein said sulfite salt (c) is an alkali metal sulfite.

10. The method of claim 5, wherein said alkaline agent (d) is sodium carbonate or potassium carbonate.

11. The method of claim 1, wherein said compound represented by the general formula (I) is selected from the group consisting of

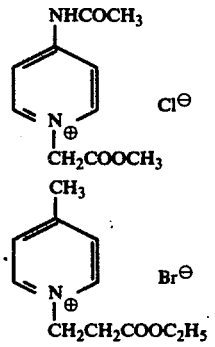

(V)

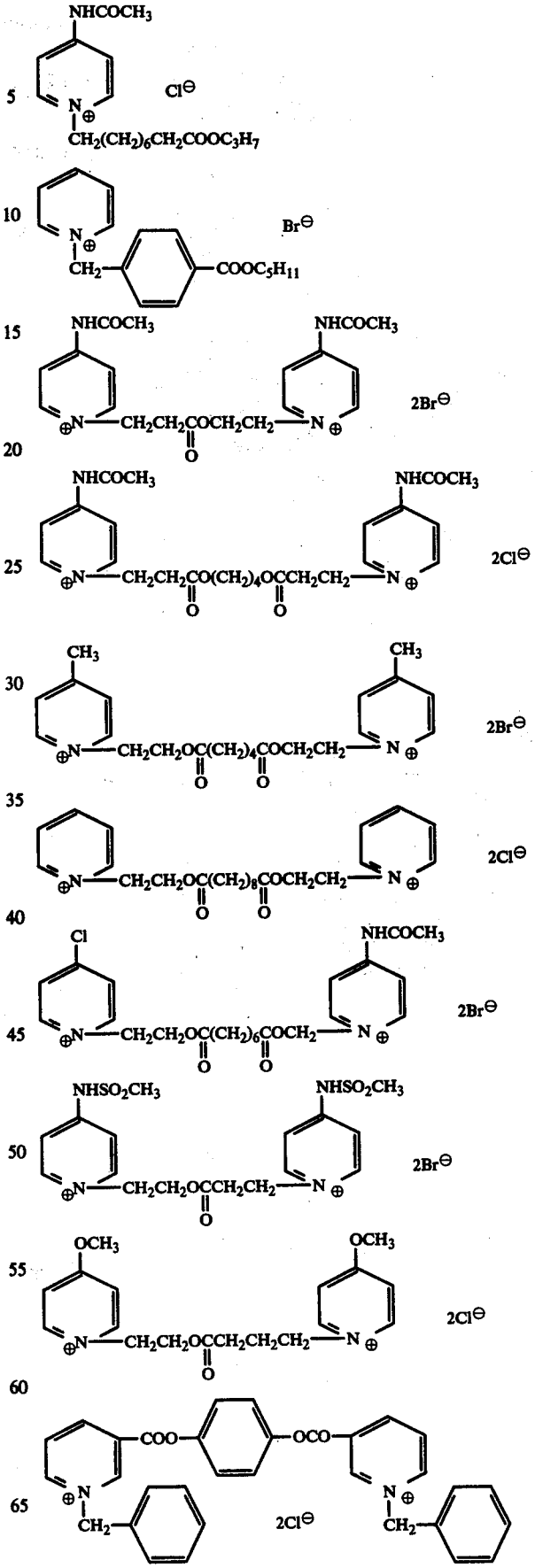

-continued

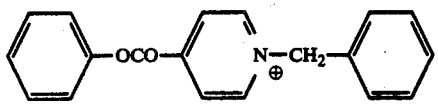

$Br^{\ominus}$

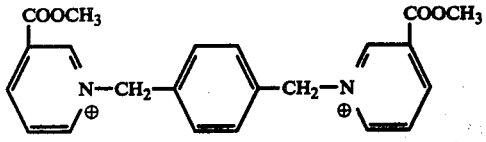

$2Br^{\ominus}$

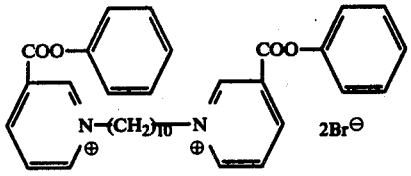

$2Br^{\ominus}$

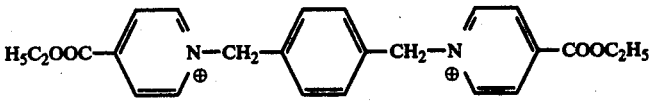

$2Br^{\ominus}$ or

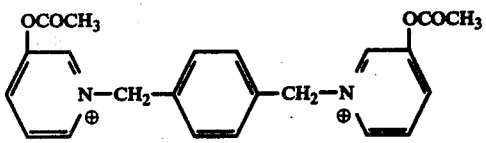

$2Br^{\ominus}$.

12. The method of claim 1, wherein said compound represented by the general formula (I) is incorporated into said silver halide photographic emulsion layer (i).

13. The method of claim 1, wherein said lith developer comprises hydroquinone as a developing agent, an aldehyde-alkali metal bisulfite adduct as a sulfite ion buffer and an alkali metal sulfite in an amount of not higher than about 5 g per liter of the lith developer.

14. The method of claim 1, said photosensitive element further comprising a flexible support having thereon said layers (i) and (ii).

15. The method of claim 14, wherein said compound of the general formula (I) is added to said layer (i) and/or (ii) before said layer (i) and/or (ii) is coated on said support.

* * * * *